US006910765B2

(12) United States Patent
Pan et al.

(10) Patent No.: US 6,910,765 B2
(45) Date of Patent: Jun. 28, 2005

(54) PHASE CHANGE INK IMAGING COMPONENT WITH OUTER LAYER HAVING HALOELASTOMER WITH PENDANT CHAINS

(75) Inventors: David H. Pan, Rochester, NY (US); Santokh S. Badesha, Pittsford, NY (US); Donald S. Stanton, Penfield, NY (US); Anthony Yeznach, Clackamas, OR (US); Trevor J. Snyder, Newberg, OR (US)

(73) Assignee: Xerox Corporation, Stamford, CT (US)

( * ) Notice: Subject to any disclaimer, the term of this patent is extended or adjusted under 35 U.S.C. 154(b) by 20 days.

(21) Appl. No.: 10/177,909

(22) Filed: Jun. 20, 2002

(65) Prior Publication Data

US 2003/0234840 A1 Dec. 25, 2003

(51) Int. Cl.[7] ..... B41J 2/01
(52) U.S. Cl. ..... 347/103

(58) Field of Search ..... 347/103; 101/217; 428/36.8, 36.91, 319.3, 421, 422, 447, 448, 450, 906; 492/56; 524/504, 551; 399/308, 318

(56) References Cited

U.S. PATENT DOCUMENTS

| | | | | |
|---|---|---|---|---|
| 5,372,852 A | * | 12/1994 | Titterington et al. | 427/288 |
| 5,537,194 A | | 7/1996 | Henry et al. | 355/271 |
| 5,736,250 A | * | 4/1998 | Heeks et al. | 428/447 |
| 6,009,298 A | * | 12/1999 | Sakamaki et al. | 399/318 |
| 6,295,434 B1 | * | 9/2001 | Chang et al. | 399/297 |

* cited by examiner

*Primary Examiner*—Anh T. N. Vo
(74) *Attorney, Agent, or Firm*—Annette L. Bad

(57) ABSTRACT

An offset printing apparatus having a coated imaging member for use with phase-change inks, has a substrate, an optional intermediate layer, and thereover an outer coating with a haloelastomer having pendant chains covalently bonded to a backbone of the haloelastomer, and an optional heating member associated with the offset printing apparatus.

21 Claims, 2 Drawing Sheets

PHASE CHANGE INK IMAGING COMPONENT WITH OUTER LAYER HAVING HALOELASTOMER WITH PENDANT CHAINS

CROSS REFERENCE TO RELATED APPLICATIONS

Reference is made to the following commonly assigned, copending patent applications, including U.S. patent application Ser. No. 10/177,909, filed Jun. 20, 2002, entitled, "Phase Change Ink Imaging Component with Outer Layer Having Haloelastomer with Pendant Chains;" U.S. patent application Ser. No. 10/177,780, filed Jun. 20, 2002, entitled, "Phase Change Ink Imaging Component with Thermoplastic Layer;" U.S. patent application Ser. No. 10/177,911, filed Jun. 20, 2002, entitled, "Phase Change Ink Imaging Component with Thermoset Layer;"; U.S. patent application Ser. No. 10/177,800, filed Jun. 20, 2002, entitled, "Phase Change Ink Imaging Component with Fluorosilicone Layer;" U.S. patent application Ser. No. 10/177,906, filed Jun. 20, 2002, entitled, "Phase Change Ink Imaging Component with Latex Fluoroelastomer Layer;" U.S. patent application Ser. No. 10/177,904, filed Jun. 20, 2002, entitled, "Phase Change Ink Imaging Component with Mica-Type Silicate Layer;" U.S. patent application Ser. No. 10/177,910, filed Jun. 20, 2002, entitled, "Phase Change Ink Imaging Component with Q-Resin Layer;" U.S. patent application Ser. No. 10/177,779, filed Jun. 20, 2002, now U.S. Pat. No. 6,648,467 entitled, "Phase Change Ink Imaging Component with Polymer Blend Layer;" and U.S. patent application Ser. No. 10/177,908, filed 20, 2002, entitled, "Phase Change Ink Imaging Component with Polymer Hybrid Layer." The disclosure of each of these patent applications is hereby incorporated by reference in their entirety.

BACKGROUND OF THE INVENTION

The present invention relates generally to an imaging apparatus and layers for components thereof, and for use in offset printing or ink jet printing apparatuses. The layers herein are useful for many purposes including layers for transfer components, including transfix or transfuse components, imaging components, and like components. More specifically, the present invention relates to layers comprising a haloelastomer having pendant chains covalently bonded to the backbone of the haloelastomer. The layers of the present invention may be useful in components used in combination with ink or dye materials. In embodiments, the layers can be used in combination with phase change inks such as solid inks.

Ink jet printing systems using intermediate transfer, transfix or transfuse members are well known, such as that described in U.S. Pat. No. 4,538,156. Generally, the printing or imaging member is employed in combination with a printhead. A final receiving surface or print medium is brought into contact with the imaging surface after the image has been placed thereon by the nozzles of the printhead. The image is then transferred and fixed to a final receiving surface.

More specifically, the phase-change ink imaging process begins by first applying a thin liquid, such as, for example, silicone oil, to an imaging member surface. The solid or hot melt ink is placed into a heated reservoir where it is maintained in a liquid state. This highly engineered ink is formulated to meet a number of constraints, including low viscosity at jetting temperatures, specific visco-elastic properties at component-to-media transfer temperatures, and high durability at room temperatures. Once within the printhead, the liquid ink flows through manifolds to be ejected from microscopic orifices through use of proprietary piezoelectric transducer (PZT) printhead technology. The duration and amplitude of the electrical pulse applied to the PZT is very accurately controlled so that a repeatable and precise pressure pulse can be applied to the ink, resulting in the proper volume, velocity and trajectory of the droplet. Several rows of jets, for example four rows, can be used, each one with a different color. The individual droplets of ink are jetted onto the liquid layer on the imaging member. The imaging member and liquid layer are held at a specified temperature such that the ink hardens to a ductile visco-elastic state.

After depositing the image, a print medium is heated by feeding it through a preheater and into a nip formed between the imaging member and a pressure member, either or both of which can also be heated. A high durometer synthetic pressure member is placed against the imaging member in order to develop a high-pressure nip. As the imaging member rotates, the heated print medium is pulled through the nip and is pressed against the deposited ink image with the help of a pressure member, thereby transferring the ink to the print medium. The pressure member compresses the print medium and ink together, spreads the ink droplets, and fuses the ink droplets to the print medium. Heat from the preheated print medium heats the ink in the nip, making the ink sufficiently soft and tacky to adhere to the print medium. When the print medium leaves the nip, stripper fingers or other like members, peel it from the printer member and direct it into a media exit path.

To optimize image resolution, the transferred ink drops should spread out to cover a predetermined area, but not so much that image resolution is compromised or lost. The ink drops should not melt during the transfer process. To optimize printed image durability, the ink drops should be pressed into the paper with sufficient pressure to prevent their inadvertent removal by abrasion. Finally, image transfer conditions should be such that nearly all the ink drops are transferred from the imaging member to the print medium. Therefore, it is desirable that the imaging member has the ability to transfer the image to the media sufficiently.

The imaging member is multi-functional. First, the ink jet printhead prints images on the imaging member, and thus, it is an imaging member. Second, after the images are printed on the imaging member, they can then transfixed or transfused to a final print medium. Therefore, the imaging member provides a transfix or transfuse function, in addition to an imaging function.

In order to ensure proper transfer and fusing of the ink off the imaging member to the print medium, certain nip temperature, pressure and compliance are required. Unlike laser printer imaging technology in which solid fills are produced by sheets of toner, the solid ink is placed on the imaging member one pixel at a time and the individual pixels must be spread out during the transfix process to achieve a uniform solid fill. Also, the secondary color pixels on the imaging member are physically taller than the primary color pixels because the secondary pixels are produced from two primary pixels. Therefore, compliance in the nip is required to conform around the secondary pixels and to allow the primary pixel neighbors to touch the media with enough pressure to spread and transfer. The correct amount of temperature, pressure and compliance is required to produce acceptable image quality.

Currently, the imaging member useful for solid inks or phase change inks comprises anodized aluminum. This member operates at about 57° C. to about 64° C. and can be used with a heater that preheats the print media prior to entering the nip. Otherwise, the imaging member may include a heater associated therewith. The heater may be associated anywhere on the offset printing apparatus. The current aluminum imaging member has several drawbacks. A high nip load of up to about 770 pounds is needed for transfix or transfuse operations. Further, because of the high nip load, bulky mechanisms and supporting structures are needed, resulting in increased printer weight and cost. One example is that a fairly complex two-layer pressure roller is needed. In addition, the first copy out time is unacceptable because of the bulky weight. Moreover, low cohesive failure temperature is another drawback to use of an anodized aluminum drum.

Several coatings for the imaging member have been suggested. Examples are listed below.

U.S. Pat. No. 5,092,235 discloses a pressure fixing apparatus for ink jet inks having 1) outer shell of rigid, non-compliant material such as steel, or polymer such as acetal homopolymer or Nylon 6/6 and 2) an underlayer of elastomer material having a hardness of about 30 to 60, or about 50 to 60.

U.S. Pat. No. 5,195,430 discloses a pressure fixing apparatus for ink jet inks having 1) outer shell of rigid, non-compliant material such as steel, or polymer such as acetal homopolymer or Nylon 6/6 and 2) an underlayer of elastomer material having a hardness of about 30 to 60, or about 50 to 60, which can be polyurethane (VIBRATHANE, or REN:C:O-thane).

U.S. Pat. No. 5,389,958 discloses an intermediate transfer member/image receiving member having a surface of metal (aluminum, nickel, iron phosphate), elastomers (fluoroelastomers, perfluoroelastomers, silicone rubber, polybutadiene), plastics (polyphenylene sulfide), thermoplastics (polyethylene, polyamide (nylon), FEP), thermosets (metals, ceramics), and a pressure roller with elastomer surface.

U.S. Pat. No. 5,455,604 discloses a fixing mechanism and pressure wheels, wherein the pressure wheels can be comprised of a steel or plastic material such as DELRIN. Image-receiving drum 40 can be a rigid material such as aluminum or stainless steel with a thin shell mounted to the shaft, or plastic.

U.S. Pat. No. 5,502,476 teaches a pressure roller having a metallic core with elastomer coating such as silicones, urethanes, nitrites, or EPDM, and an intermediate transfer member surface of liquid, which can be water, fluorinated oils, glycol, surfactants, mineral oil, silicone oil, functional oils such as mercapto silicone oils or fluorinated silicone oils or the like, or combinations thereof.

U.S. Pat. No. 5,614,933 discloses an intermediate transfer member/image receiving member having a surface of metal (aluminum, nickel, iron phosphate), elastomers (fluoroelastomers, perfluoroelastomers, silicone rubber, polybutadiene), plastics (polyphenylene sulfide), thermoplastics (polyethylene, polyamide (nylon), FEP), thermosets (metals, ceramics), or polyphenylene sulfide loaded with PTFE, and a pressure roller with elastomer surface.

U.S. Pat. No. 5,790,160 discloses an intermediate transfer member/image receiving member having a surface of metal (aluminum, nickel, iron phosphate), elastomers (fluoroelastomers, perfluoroelastomers, silicone rubber, polybutadiene), plastics (polyphenylene sulfide), thermoplastics (polyethylene, polyamide (nylon), FEP), thermosets (metals, ceramics), or polyphenylene sulfide loaded with PTFE, and a pressure roller with elastomer surface.

U.S. Pat. No. 5,805,191 an intermediate transfer member/image receiving member having a surface of metal (aluminum, nickel, iron phosphate), elastomers (fluoroelastomers, perfluoroelastomers, silicone rubber, polybutadiene), plastics (polyphenylene sulfide), thermoplastics (polyethylene, polyamide (nylon), FEP), thermosets (metals, ceramics), or polyphenylene sulfide loaded with PTFE, and an outer liquid layer of liquid, which can be water, fluorinated oils, glycol, surfactants, mineral oil, silicone oil, functional oils such as mercapto silicone oils or fluorinated silicone oils or the like, or combinations thereof.

U.S. Pat. No. 5,808,645 discloses a transfer roller having a metallic core with elastomer covering of silicone, urethanes, nitriles, EPDM.

U.S. Pat. No. 6,196,675 B1 discloses separate image transfer and fusing stations, wherein the fuser roller coatings can be silicones, urethanes, nitrites and EPDM.

U.S. Pat. No. 5,777,650 discloses a pressure roller having an elastomer sleeve, and an outer coating that can be metals, (aluminum, nickel, iron phosphate), elastomers (fluoroelastomers, perfluoroelastomers, silicone rubber, polybutadiene), plastics (polyphenylene sulfide with PTFE filler), thermoplastics (polyethylene, polyamide (nylon), FEP), thermosets (acetals, ceramics). Preferred is annodized aluminum.

In addition, many different types of outer coatings for transfer members, fuser members, and intermediate transfer members have been used in the electrostatographic arts using powder toner, but not with liquid inks or phase change inks. Several examples are listed herein.

U.S. Pat. No. 5,361,126 discloses an imaging apparatus including a transfer member including a heater and pressure-applying roller, wherein the transfer member includes a fabric substrate and an impurity-absorbent material as a top layer. The impurity-absorbing material can include a rubber elastomer material.

U.S. Pat. No. 5,337,129 discloses an intermediate transfer component comprising a substrate and a ceramer or grafted ceramer coating comprised of integral, interpenetrating networks of haloelastomer, silicon oxide, and optionally polyorganosiloxane.

U.S. Pat. No. 5,340,679 discloses an intermediate transfer component comprised of a substrate and thereover a coating comprised of a volume grafted elastomer, which is a substantially uniform integral interpenetrating network of a hybrid composition of a fluoroelastomer and a polyorganosiloxane.

U.S. Pat. No. 5,480,938 describes a low surface energy material comprising a volume grafted elastomer which is a substantially uniform integral interpenetrating network of a hybrid composition of a fluoroelastomer and a polyorganosiloxane, the volume graft having been formed by dehydrofluorination of fluoroelastomer by a nucleophilic dehydrofluorinating agent, followed by a hydrosilation reaction, addition of a hydrogen functionally terminated polyorganosiloxane and a hydrosilation reaction catalyst U.S. Pat. No. 5,366,772 describes a fuser member comprising a supporting substrate, and a outer layer comprised of an integral interpenetrating hybrid polymeric network comprised of a haloelastomer, a coupling agent, a functional polyorganosiloxane and a crosslinking agent.

U.S. Pat. No. 5,456,987 discloses an intermediate transfer component comprising a substrate and a titamer or grafted titamer coating comprised of integral, interpenetrating networks of haloelastomer, titanium dioxide, and optionally polyorganosiloxane.

U.S. Pat. No. 5,848,327 discloses an electrode member positioned near the donor member used in hybrid scavengeless development, wherein the electrode members have a composite haloelastomer coating.

U.S. Pat. No. 5,576,818 discloses an intermediate toner transfer component including: (a) an electrically conductive substrate; (b) a conformable and electrically resistive layer comprised of a first polymeric material; and (c) a toner release layer comprised of a second polymeric material selected from the group consisting of a fluorosilicone and a substantially uniform integral interpenetrating network of a hybrid composition of a fluoroelastomer and a polyorganosiloxane, wherein the resistive layer is disposed between the substrate and the release layer.

U.S. Pat. No. 6,035,780 discloses a process for forming a layer on a component of an electrostatographic apparatus, including mixing a first fluoroelastomer and a polymeric siloxane containing free radical reactive functional groups, and forming a second mixture of the resulting product with a mixture of a second fluoroelastomer and a second polysiloxane compound.

U.S. Pat. No. 5,537,194 discloses an intermediate toner transfer member comprising: (a) a substrate; and (b) an outer layer comprised of a haloelastomer having pendant hydrocarbon chains covalently bonded to the backbone of the haloelastomer.

U.S. Pat. No. 5,753,307 discloses fluoroelastomer surfaces and a method for providing a fluoroelastomer surface on a supporting substrate which includes dissolving a fluoroelastomer; adding a dehydrofluorinating agent; adding an amino silane to form a resulting homogeneous fluoroelastomer solution; and subsequently providing at least one layer of the homogeneous fluoroelastomer solution to the supporting substrate.

U.S. Pat. No. 5,840,796 describes polymer nanocomposites including a mica-type layered silicate and a fluoroelastomer, wherein the nanocomposite has a structure selected from the group consisting of an exfoliated structure and an intercalated structure.

U.S. Pat. No. 5,846,643 describes a fuser member for use in an electrostatographic printing machine, wherein the fuser member has at least one layer of an elastomer composition comprising a silicone elastomer and a mica-type layered silicate, the silicone elastomer and mica-type layered silicate form a delaminated nanocomposite with silicone elastomer inserted among the delaminated layers of the mica-type layered silicate.

It is desired to provide a multi-functional imaging member for use with phase change ink printing machines, which has the ability to receive an image, and either transfer or transfer and fuse the image to a print medium. It is desired that the imaging member when having heat associated therewith, be thermally stable for conduction for fusing or fixing. It is further desired that the imaging member have a relatively low nip load, in order to decrease the weight and cost of the printing machine, and in order to provide an acceptable first copy out time.

SUMMARY OF THE INVENTION

The present invention provides, in embodiments: an offset printing apparatus for transferring a phase change ink onto a print medium comprising: a) a phase change ink component for applying a phase change ink in a phase change ink image; b) an imaging member for accepting the phase change ink image from the phase change ink component, and transferring the phase change ink image from the imaging member to the print medium, the imaging member comprising: i) an imaging substrate, and thereover ii) an outer coating comprising a haloelastomer having pendant chains covalently bonded to a backbone of the haloelastomer.

The present invention further provides, in embodiments: an offset printing apparatus for printing a phase change ink onto a print medium comprising: a) a phase change ink component for applying a phase change ink in a phase change ink image; b) an imaging member for accepting said phase change ink image from said phase change ink component, and transferring the phase change ink image from said imaging member to said print medium and for fixing the phase change ink image to said print medium, the imaging member comprising: i) an imaging substrate, and thereover ii) an outer coating comprising a haloelastomer having pendant hydrocarbon chains covalently bonded to a backbone of the haloelastomer; and c) a heating member associated with the offset printing apparatus.

In addition, the present invention provides, in embodiments: an offset printing apparatus comprising a phase change ink component containing a phase change ink; a imaging member comprising a substrate, and thereover an outer coating comprising a haloelastomer having pendant chains covalently bonded to a backbone of the haloelastomer; and a heating member associated with the offset printing apparatus, wherein the phase change ink component dispenses the phase change ink onto the imaging member, and wherein the phase change ink is solid at about 25° C.

BRIEF DESCRIPTION OF THE DRAWINGS

The above embodiments of the present invention will become apparent as the following description proceeds upon reference to the drawings, which include the following figures.

DETAILED DESCRIPTION OF THE INVENTION

The present invention is directed to an offset printing apparatus useful with phase-change inks such as solid inks, and comprising a coated imaging member capable of accepting, transferring and in some embodiments, fixing an ink image to a print medium. The imaging member can be a roller such as a drum, or a film component such as a film, sheet, belt or the like. In embodiments, the imaging member comprises a substrate and an outer layer comprising a haloelastomer. In an alternative embodiment, the imaging member comprises a substrate, an optional intermediate layer, and outer layer comprising a haloelastomer. The substrate, intermediate layer, and/or outer layer can further comprise fillers dispersed or contained therein.

The details of embodiments of phase-change ink printing processes are described in the patents referred to above, such as U.S. Pat. Nos. 5,502,476; 5,389,958; and 6,196,675 B1, the disclosures of each of which are hereby incorporated by reference in their entirety.

Figure 1:
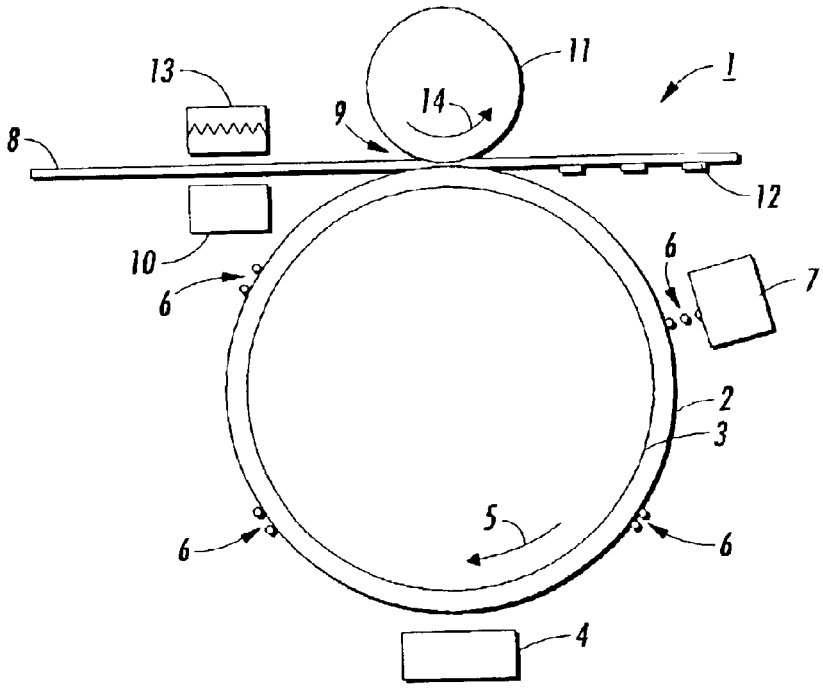
FIG. 1 is an illustration of an embodiment of the invention, and includes a transfer printing apparatus using an imaging member in the form of a drum.

Referring to FIG. 1, offset printing apparatus 1 is demonstrated to show transfer of an ink image from the imaging member to a final printing medium or receiving substrate. As the imaging member 3 turns in the direction of arrow 5, a liquid surface 2 is deposited on imaging member 3. The imaging member 3 is depicted in this embodiment as a drum member. However, it should be understood that other embodiments can be used, such as a belt member, film member, sheet member, or the like. The liquid layer 2 is deposited by an applicator 4 that may be positioned at any place, as long as the applicator 4 has the ability to make contact and apply liquid surface 2 to imaging member 3.

The ink used in the printing process can be a phase change ink, such as, for example, a solid ink. The term "phase change ink" means that the ink can change phases, such as a solid ink becoming liquid ink or changing from solid into a more malleable state. Specifically, in embodiments, the ink can be in solid form initially, and then can be changed to a molten state by the application of heat energy. The solid ink may be solid at room temperature, or at about 25° C. The solid ink may possess the ability to melt at relatively high temperatures above from about 85° C. to about 150° C. The ink is melted at a high temperature and then the melted ink 6 is ejected from printhead 7 onto the liquid layer 2 of imaging member 3. The ink is then cooled to an intermediate temperature of from about 20° C. to about 80° C., or about 72° C., and solidifies into a malleable state in which it can then be transferred onto a final receiving substrate 8 or print medium 8.

The ink has a viscosity of from about 5 to about 30 centipoise, or from about 8 to about 20 centipoise, or from about 10 to about 15 centipoise at about 140° C. The surface tension of suitable inks is from about 23 to about 50 dynes/cm. Examples of a suitable inks for use herein include those described in U.S. Pat. Nos. 4,889,560; 5,919,839; 6,174,937; and 6,309,453, the disclosure each of which are hereby incorporated by reference in their entirety.

Some of the liquid layer 2 is transferred to the print medium 8 along with the ink. A typical thickness of transferred liquid is about 100 angstroms to about 100 nanometer, or from about 0.1 to about 200 milligrams, or from about 0.5 to about 50 milligrams, or from about 1 to about 10 milligrams per print medium.

Suitable liquids that may be used as the print liquid surface 2 include water, fluorinated oils, glycol, surfactants, mineral oil, silicone oil, functional oils, and the like, and mixtures thereof. Functional liquids include silicone oils or polydimethylsiloxane oils having mercapto, fluoro, hydride, hydroxy, and the like functionality.

Feed guide(s) 10 and 13 help to feed the print medium 8, such as paper, transparency or the like, into the nip 9 formed between the pressure member 11 (shown as a roller), and imaging member 3. It should be understood that the pressure member can be in the form of a belt, film, sheet, or other form. In embodiments, the print medium 8 is heated prior to entering the nip 9 by heated feed guide 13. When the print medium 8 is passed between the printing medium 3 and the pressure member 11, the melted ink 6 now in a malleable state is transferred from the imaging member 3 onto the print medium 8 in image configuration. The final ink image 12 is spread, flattened, adhered, and fused or fixed to the final print medium 8 as the print medium moves between nip 9. Alternatively, there may be an additional or alternative heater or heaters (not shown) positioned in association with offset printing apparatus 1. In another embodiment, there may be a separate optional fusing station located upstream or downstream of the feed guides.

The pressure exerted at the nip 9 is from about 10 to about 1,000 psi., or about 500 psi, or from about 200 to about 500 psi. This is approximately twice the ink yield strength of about 250 psi at 50° C. In embodiments, higher temperatures, such as from about 72 to about 75° C. can be used, and at the higher temperatures, the ink is softer. Once the ink is transferred to the final print medium 8, it is cooled to an ambient temperature of from about 20° C. to about 25° C.

Stripper fingers (not shown) may be used to assist in removing the print medium 8 having the ink image 12 formed thereon to a final receiving tray (also not shown).

Figure 2:
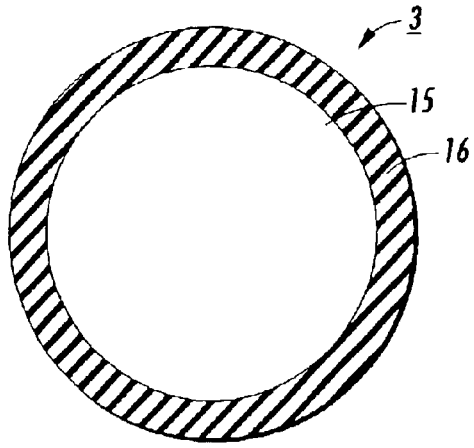
FIG. 2 is an enlarged view of an embodiment of a printing drum having a substrate and an outer elastomer layer thereon.

FIG. 2 demonstrates an embodiment of the invention, wherein imaging member 3 comprises substrate 15, having thereover outer coating 16.

Figure 3:
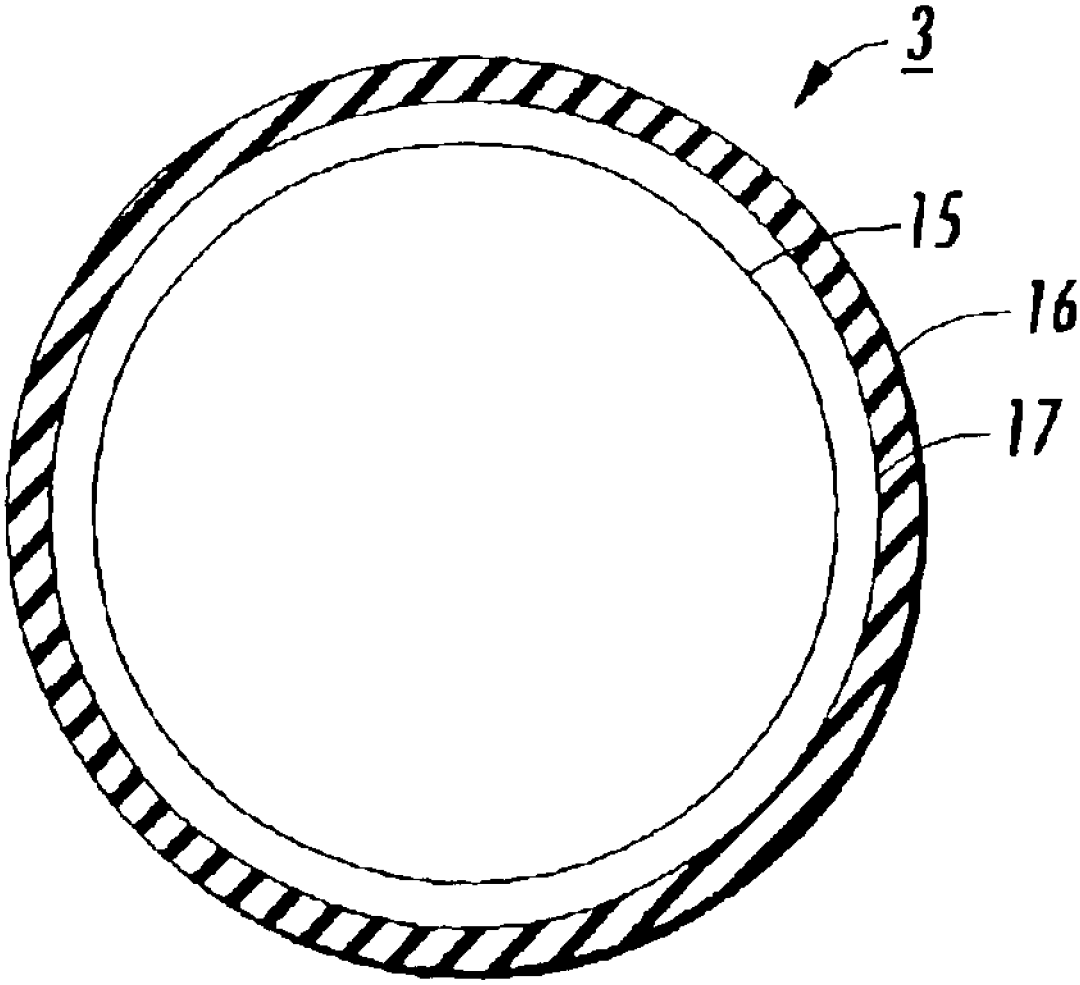
FIG. 3 is an enlarged view of an embodiment of a printing drum having a substrate, and optional intermediate, and an outer elastomer layer thereon.

FIG. 3 depicts another embodiment of the invention. FIG. 3 depicts a three-layer configuration comprising a substrate 15, intermediate layer 17 positioned on the substrate 15, and outer layer 16 positioned on the intermediate layer 17. In embodiments, an outer liquid layer 2 (as described above) may be present on the outer layer 16.

In embodiments, the outer release layer 16 comprises a haloelastomer having pendant chains covalently bonded to the backbone of the haloelastomer.

The present haloelastomer configuration differs from known configurations in that the pendant polymer chains are appended to the backbone of the haloelastomer optionally with at least one end freely dangling, in contrast to known chains which are an integral part of the backbone such as random or block copolymers comprising polymer segments and haloelastomer segments. Accordingly, the polymer chains are referred to herein as being pendant polymer chains.

The pendant polymer chains may be either dispersed or contained in the outer surface layer of the outer imaging layer, and in embodiments, in a uniform manner. In embodiments, the pendant chains can be present over the entire surface layer of the outer layer. In embodiments, the pendent chains are dispersed or contained in an amount of from about 75 to about 100, or from about 95 to about 100 percent of the outer surface layer of the outer imaging layer.

As used herein, the phrase "surface graft" refers to the presence of the pendant chains at the surface of the outer layer to a depth less than the entire thickness of the outer layer. The depth of the surface graft ranges, for example, from about 100 to about 5,000 angstroms, or from about 150 to about 2,000 angstroms. As used herein, the term "volume graft" refers to the presence of the pendant chains in the entire thickness of the outer layer.

The pendant chains can be covalently bonded to the haloelastomer by any suitable known method. For example, the pendant polymer chains may have one or more functional end groups. The general reaction mechanism can involve the dehydrohalogenation of the haloelastomer, thereby creating double bond sites, with subsequent nucleophilic insertion of the functional end groups of the polymer chains at the double bond sites. In the surface graft case, cured or uncured haloelastomer films or coatings can be surface treated with a grafting agent which may be, for example, an amino terminated polymer or oligomer chain such as hexadecylamine, C18–24 amine, oleylamine, polyoxyethylene (POE) oleylamine, POE C18–24 tert-amine, monoaminopropyl terminated polydimethylsiloxane. The amino functionality may be a primary, secondary, or tertiary amine as described herein. The main reaction is as stated above involving dehydrohalogenation followed by the nucleophilic attack of the amino functionality to the reactive sites. These reactive sites are carbon-carbon double bonds. As a result, the graft is on the surface of the imaging member.

The dehydrohalogenating agent, which attacks the haloelastomer generating unsaturation, is selected from the group of strong nucleophilic agents such as peroxides, hydrides, bases, oxides, and the like. Examples of agents are selected from the group consisting of primary, secondary and tertiary, aliphatic and aromatic amines, where the aliphatic and aromatic groups have from about 2 to about 15 carbon atoms. Other examples include aliphatic and aromatic diamines and triamines having from about 2 to about 15 carbon atoms where the aromatic groups may be benzene, toluene, naphthalene, anthracene, or the like. In embodiments, for the aromatic diamines and triamines, the aromatic group can be substituted in the ortho, meta and para positions. Typical substituents include lower alkylamino groups such as ethylamino, propylamino and butylamino. Specific amine dehydrohalogenating agents include N-(2-aminoethyl-3-aminopropyl)-trimethoxy silane, 3-(N-styrylmethyl-2-aminoethylamino) propyltrimethoxy silane hydrochloride and (aminoethylamino methyl) phenylethyltrimethoxy silane.

Conversely, a volume graft is made in solution. To prepare a volume graft, the basic steps are the same, and include dehydrohalogenation followed by nucleophilic attack which results in the formation of the covalent bonds between the haloelastomer and the amino terminated polymer chain. The volume graft solution is then cured.

Suitable haloelastomers for use herein include any suitable halogen-containing elastomer such as chloroelastomers, bromoelastomers, fluoroelastomers, or mixtures thereof. Examples of haloelastomers comprising halogen monomers include fluoroelastomers comprising copolymers and terpolymers of vinylidenefluoride, hexafluoropropylene and tetrafluoroethylene, which are known commercially under various designations as VITON A®, VITON E®, VITON E60C®, VITON E45®, VITON E430®, VITON B 910®, VITON GH®, VITON B50®, VITON E45®, VITON F®, VITON GBL®, VITON GFLT®, and VITON GF®. The VITON® designation is a Trademark of E.I. DuPont de Nemours, Inc. Three known fluoroelastomers are (1) a class of copolymers of vinylidenefluoride, hexafluoropropylene and tetrafluoroethylene, known commercially as VITON A®, (2) a class of terpolymers of vinylidenefluoride, hexafluoropropylene and tetrafluoroethylene known commercially as VITON B®, and (3) a class of tetrapolymers of vinylidenefluoride, hexafluoropropylene or perfluoromethylvinyl ether, tetrafluoroethylene and a cure site monomer, for example, VITON® GF. VITON A®, and VITON B®, and other VITON® designations are trademarks of E.I. DuPont de Nemours and Company.

In another embodiment, the fluoroelastomer is a tetrapolymer having a relatively low quantity of vinylidenefluoride. An example is VITON GF®, available from E.I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomer.

In embodiments, these fluoroelastomers are cured with a nucleophilic addition curing system, such as a bisphenol crosslinking agent with an organophosphonium salt accelerator as described in further detail in the above-referenced Lentz patent and in U.S. Pat. No. 5,017,432. The fluoroelastomer is generally cured with bisphenol phosphonium salt, or a conventional aliphatic peroxide curing agent.

Other fluoroelastomers that may be used include AFLAS®, FLUOREL® I, FLUOREL® II, TECHNOFLON® and like commercially-available haloelastomers.

Unless otherwise indicated, the discussion herein of the pendant chains refers to the unreacted form. Each of the pendant chains (excluding any carbon atoms which may be in the functional groups) has, for example, from about 6 to about 100 carbon, nitrogen, oxygen, silicone or like heteroatoms, or from about 8 to about 50 of the listed heteroatoms. The chains, in embodiments, are saturated such as alkanes like hexane, heptane, decane, octadecane, and the like. Each chain may have one, two, or more functional groups, a functional group coupled to, for instance, an end carbon atom, to facilitate covalent bonding of the chain to the backbone of the haloelastomer. In embodiments, each chain has only one functional end group. The functional group or groups may be, for example, —OH, —$NH_2$, —NRH, —SH, —$NHCO_2$, or the like, where R is hydrogen or a lower alkyl having, for example, from about 1 to about 4 carbon atoms. In embodiments, from about 85 to about 100, or from about 95 to about 100 percent of the chains are saturated.

The haloelastomer with pendant polymer chains is present in the imaging outer layer in an amount of from about 95 to about 35 percent, or from about 90 to about 50 percent, or from about 80 to about 70 percent by weight of total solids. Total solids as used herein refers to the total amount by weight of haloelastomer, filler, and any additional additives, fillers or like solid materials.

In embodiments, the thickness of the outer imaging layer is from about 0.5 to about 20 mils, or from about 1 to about 6 mils.

The substrate, optional intermediate layer, and/or outer layer, in embodiments, may comprise fillers dispersed therein. These fillers can have the ability to increase the material hardness or modulus into the desired range.

Examples of fillers include fillers such as metals, metal oxides, doped metal oxides, carbon blacks, ceramics, polymers, and the like, and mixtures thereof. Examples of suitable metal oxide fillers include titanium dioxide, tin (II) oxide, aluminum oxide, indium-tin oxide, magnesium oxide, copper oxide, iron oxide, silica or silicon oxide, and the like, and mixtures thereof. Examples of carbon fillers include carbon black (such as N-990 thermal black, N330 and N110 carbon blacks, and the like), graphite, fluorinated carbon (such as ACCUFLUOR® or CARBOFLUOR®), and the like, and mixtures thereof. Examples of ceramic materials include aluminum nitrate, boron nitride, silicates such as zirconium silicates, and the like, and mixtures thereof. Examples of polymer fillers include polytetrafluoroethylene powder, polypyrrole, polyacrylonitrile (for example, pyrolyzed polyacrylonitrile), polyaniline, polythiophenes, and the like, and mixtures thereof. The optional filler is present in the substrate, optional intermediate layer, and/or outer layer in an amount of from about 0 to about 30 percent, or from about 1 to about 20 percent, or from about 1 to about 5 percent by weight of total solids in the layer.

The imaging substrate can comprise any material having suitable strength for use as an imaging member substrate. Examples of suitable materials for the substrate include metals, rubbers, fiberglass composites, and fabrics.

Examples of metals include steel, aluminum, nickel, and their alloys, and like metals, and alloys of like metals. The thickness of the substrate can be set appropriate to the type of imaging member employed. In embodiments wherein the substrate is a belt, film, sheet or the like, the thickness can be from about 0.5 to about 500 mils, or from about 1 to about 250 mils. In embodiments wherein the substrate is in the form of a drum, the thickness can be from about 1/32 to about 1 inch, or from about 1/16 to about 5/8 inch.

Examples of suitable imaging substrates include a sheet, a film, a web, a foil, a strip, a coil, a cylinder, a drum, an endless strip, a circular disc, a belt including an endless belt, an endless seamed flexible belt, an endless seamless flexible belt, an endless belt having a puzzle cut seam, a weldable seam, and the like.

In an optional embodiment, an intermediate layer may be positioned between the imaging substrate and the outer layer. Materials suitable for use in the intermediate layer include silicone materials, fluoroelastomers, fluorosilicones, ethylene propylene diene rubbers, and the like, and mixtures thereof. In embodiments, the intermediate layer is conformable and is of a thickness of from about 2 to about 60 mils, or from about 4 to about 25 mils.

Specific embodiments of the invention will now be described in detail. These examples are intended to be illustrative, and the invention is not limited to the materials, conditions, or process parameters set forth in these embodiments. All parts are percentages by weight of total solids as defined above unless otherwise indicated.

EXAMPLES

Example 1

Preparation of a Haloelastomer having Pendant Chains as Outer Layer

A dispersion comprising two parts was prepared as follows. Part A was prepared by adding 100 parts by weight VITON® GF obtained from DuPont Co., 25 parts by weight of Regal 250 carbon black obtained from Cabot Chemical Co., 15 parts by weight MAGLITE® YTM (MgO) in methyl isobutyl ketone ("MIBK") to a 15 percent solids mixture. Part B was prepared by adding 5 parts of VITON® Curative VC50 to 28.3 parts of methyl ethyl ketone (MEK). Part B was added to part A and roll milled for 45 minutes. The resulting dispersion was coated by drawdown method onto a 2 inch thick stainless steel sheet and dried at ambient conditions for about 24 hours, and subsequently step cured for 4 hours at 65° C., 2 hours at 93° C., 2 hours at 149° C., 2 hours at 177° C., 2 hours at 204° C, and finally 6 hours at 232° C. The resulting dry thickness of the outer layer was about 1.5 mils.

A surface graft of 1-hexadecylamine was prepared as follows. The fluoroelastomers layer was soaked for about 2 hours in a 20 percent solution of 1-hexadecylamine available from Aldrich Chemical Co., in hexane. The layer was taken out of the bath, rinsed with hexane, air dried for 5 hours, and heated in an oven for 2 hours which was maintained at about 102° C.

Example 2

Preparation of Imaging Drums

The dispersion made in accordance with Example 1 can be coated onto an aluminum imaging drum of approximately 100 mm in diameter. Prior to coating the aluminum drum is sanded and degreased with MEK solvent, dried and primed with an aminosilane primer using known methods such as flow coating, spray coating, dip coating, gravure coating, roll coating, and the like. The preferred method is flow coating. The resulting drum is then dried and step cured and surface grafted with 1-hexadecylamine in accordance with Example 1.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. An offset printing apparatus for transferring a phase change ink onto a print medium comprising:

a) a phase change ink component for applying a phase change ink, which is solid at 25° C., in a phase change ink image;

b) an imaging member for accepting said phase change ink image from said phase change ink component, and transferring the phase change ink image from said imaging member to said print medium, the imaging member comprising:

i) an imaging substrate, and thereover ii) an outer coating comprising a haloelastomer having pendant chains covalently bonded to a backbone of the haloelastomer.

2. The offset printing apparatus of claim 1, wherein each of said pendant chains has from about 6 to about 14 carbon atoms.

3. The offset printing apparatus of claim 2, wherein each of said pendant chains has from about 8 to about 12 carbon atoms.

4. The offset printing apparatus of claim 1, wherein from about 85 to about 100 percent of the pendant chains are saturated.

5. The offset printing apparatus of claim 4, wherein from about 95 to about 100 percent of the pendant chains are saturated.

6. The offset printing apparatus of claim 1, wherein said haloelastomer is a fluoroelastomer.

7. The offset printing apparatus of claim 6, wherein said fluoroelastomer is selected from the group consisting of a) copolymers of vinylidene fluoride, hexafluoropropylene and tetrafluoroethylene, b) terpolymers of vinylidene fluoride, hexafluoropropylene and tetrafluoroethylene, and c) tetrapolymers of vinylidene fluoride, hexafluoropropylene, tetrafluoroethylene and a cure site monomer.

8. The offset printing apparatus of claim 1, wherein said outer coating further comprises a filler.

9. The offset printing apparatus of claim 8, wherein said filler is selected from the group consisting of metals, metal oxides, carbon blacks, polymers, and mixtures thereof.

10. The offset printing apparatus of claim 1, wherein said imaging substrate comprises a metal.

11. The offset printing apparatus of claim 1, wherein an intermediate layer is positioned between said substrate and said outer coating.

12. The offset printing apparatus of claim 11, wherein said intermediate layer comprises a silicone material.

13. The offset printing apparatus of claim 12, wherein said intermediate layer comprises a filler.

14. The offset printing apparatus of claim 13, wherein said filler is selected from the group consisting of carbon blacks, metal oxides, metals, polymers, and mixtures thereof.

15. The offset printing apparatus of claim 1, wherein said pendant chains are located in a surface portion of said outer coating.

16. The offset printing apparatus of claim 1, wherein said pendant chains are present in from about 75 to about 100 percent of the surface of said outer coating.

17. The offset printing apparatus of claim 16, wherein said pendant chains are present in from about 95 to about 100 percent of the surface of said outer coating.

18. The offset printing apparatus of claim 1, wherein said phase change ink comprises a dye.

19. The offset printing apparatus of claim 1, wherein said pendant chains comprise a heteroatom selected from the group consisting of carbon, oxygen, nitrogen and silicon.

20. An offset printing apparatus for printing a phase change ink onto a print medium comprising:

a) a phase change ink component for applying a phase change ink in a phase change ink image;

b) an imaging member for accepting said phase change ink image from said phase change ink component, and transferring the phase change ink image from said imaging member to said print medium and for fixing the phase change ink image to said print medium, the imaging member comprising:

i) an imaging substrate, and thereover ii) an outer coating comprising a haloelastomer having pendant hydrocarbon chains covalently bonded to a backbone of the haloelastomer; and c) a heating member associated with the offset printing apparatus.

21. An offset printing apparatus comprising:

a) a phase change ink component containing a phase change ink;

b) a imaging member comprising:

i) a substrate, and thereover ii) an outer coating comprising a haloelastomer having pendant chains covalently bonded to a backbone of the haloelastomer; and c) a heating member associated with said offset printing apparatus, wherein said phase change ink component dispenses said phase change ink onto said imaging member, and wherein said phase change ink is solid at about 25° C.

* * * * *